US010751677B2

(12) United States Patent
Gericke et al.

(10) Patent No.: US 10,751,677 B2
(45) Date of Patent: Aug. 25, 2020

(54) MIXING DEVICE, IN PARTICULAR BULK MATERIAL MIXING DEVICE

(71) Applicant: Gericke AG, Regensdorf (CH)

(72) Inventors: Markus Gericke, Zollikon (CH); Ralf Weinekötter, Zurich (CH); Aleksandar Maksimovic, Wetzikon (CH); Christian Schefer, Regensdorf (CH); Reto Schaffner, Weiningen (CH)

(73) Assignee: Gericke AG, Regensdorf (CH)

( * ) Notice: Subject to any disclaimer, the term of this patent is extended or adjusted under 35 U.S.C. 154(b) by 197 days.

(21) Appl. No.: 15/794,185

(22) Filed: Oct. 26, 2017

(65) Prior Publication Data

US 2018/0117547 A1 May 3, 2018

(30) Foreign Application Priority Data

Oct. 28, 2016 (DE) ..... 10 2016 120 718

(51) Int. Cl.

| | |
|---|---|
| ***B01F 7/00*** | (2006.01) |
| ***B01F 7/02*** | (2006.01) |
| ***B01F 13/10*** | (2006.01) |
| ***B01F 15/00*** | (2006.01) |
| ***B01F 3/18*** | (2006.01) |
| ***B01F 7/04*** | (2006.01) |
| ***B01F 15/02*** | (2006.01) |

(52) U.S. Cl.

CPC ..... *B01F 7/00633* (2013.01); *B01F 3/18* (2013.01); *B01F 7/0025* (2013.01); *B01F 7/00091* (2013.01); *B01F 7/00158* (2013.01); *B01F 7/024* (2013.01); *B01F 7/042* (2013.01); *B01F 13/105* (2013.01); *B01F 15/00538* (2013.01); *B01F 15/0292* (2013.01); *B01F 2013/108* (2013.01)

(58) Field of Classification Search

CPC ..... B01F 7/042; B02C 18/142
USPC ..... 366/297
See application file for complete search history.

(56) References Cited

U.S. PATENT DOCUMENTS

| | | | |
|---|---|---|---|
| 3,490,706 | A | 1/1970 | Rogers et al. |
| 3,743,192 | A | 7/1973 | Otto |

(Continued)

FOREIGN PATENT DOCUMENTS

| | | | |
|---|---|---|---|
| CN | 105617906 | A | 6/2016 |
| DE | 4341569 | A1 | 6/1995 |

(Continued)

OTHER PUBLICATIONS

German Search Report dated Aug. 7, 2017 regarding German patent application DE 10 2016 120 718.7 (and English translation thereof).

(Continued)

*Primary Examiner* — Elizabeth Insler
(74) *Attorney, Agent, or Firm* — Posz Law Group, PLC

(57) ABSTRACT

A mixing device, in particular bulk material mixing device, with at least one mixing container comprises a receiving region for receiving a material to be mixed, with at least one mixing unit which is configured for mixing the material to be mixed that is present in the mixing container, and with at least one lump breaker unit comprising at least one cutter element which protrudes into the mixing container, wherein the at least one lump breaker unit is arranged in a frontal region of the mixing container.

13 Claims, 7 Drawing Sheets

(56) References Cited

U.S. PATENT DOCUMENTS

Figure 1:
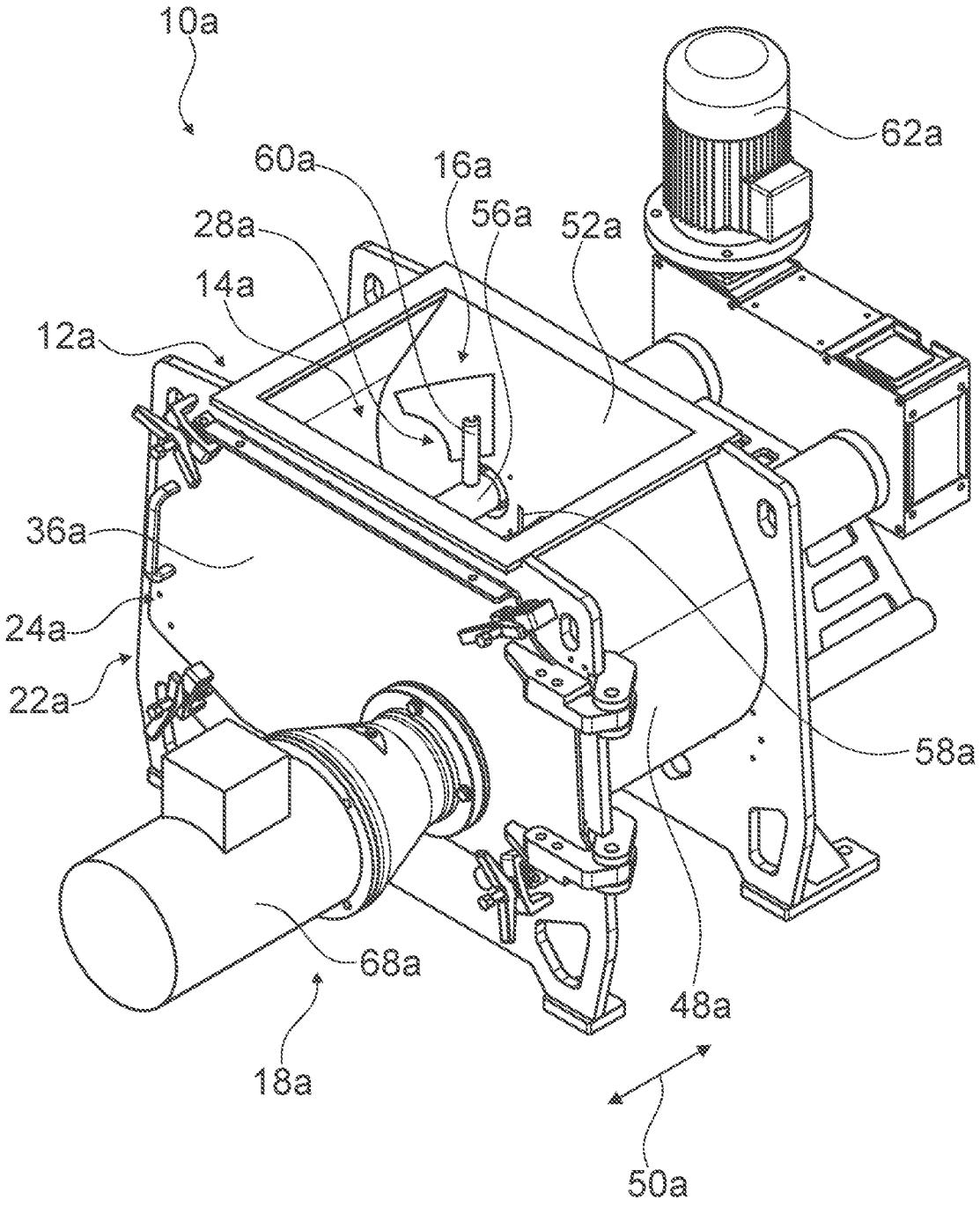

| | | | | |
|---|---|---|---|---|
| 5,148,999 | A | 9/1992 | Curfman et al. | |
| 5,803,375 | A | 9/1998 | Hartwig | |
| 8,226,022 | B2 * | 7/2012 | Bongratz ..... | B01F 7/00133 241/101.8 |
| 2012/0024996 | A1 | 2/2012 | Bongratz | |
| 2016/0091246 | A1 | 3/2016 | Nordahl | |
| 2016/0354743 | A1 * | 12/2016 | Veit ..... | B01F 7/00158 |

FOREIGN PATENT DOCUMENTS

| | | | |
|---|---|---|---|
| DE | 20 2009 015 020 | U1 | 4/2010 |
| JP | S61-157369 | A | 7/1986 |
| JP | 2003-024910 | A | 1/2003 |
| WO | 2015/169458 | A1 | 11/2015 |

OTHER PUBLICATIONS

Search Report dated Mar. 27, 2018 issued in corresponding EP patent application No. 17 198 342.2 (and English translation).
Office Action dated Oct. 7, 2019 issued in corresponding EP patent application No. 17 198 342.2 (and English translation).

* cited by examiner

MIXING DEVICE, IN PARTICULAR BULK MATERIAL MIXING DEVICE

CROSS REFERENCE TO RELATED APPLICATION

This application is based on and incorporates herein by reference German Patent Application No. 10 2016 120 718.7 filed on Oct. 28, 2016.

STATE OF THE ART

The invention relates to a mixing device, in particular a bulk material mixing device.

A mixing device, in particular a bulk material mixing device, with at least one mixing container comprising a receiving region for receiving material to be mixed, with at least one one-sidedly supported mixing unit which is configured for mixing the material to be mixed that is present in the mixing container, and with at least one lump breaker unit comprising at least one cutter element which protrudes into the mixing container, has already been proposed.

The objective of the invention is in particular to provide a generic device having improved characteristics regarding a mixing result as well as regarding a maintenance comfort. The objective is achieved, according to the invention, by the features of patent claim 1 while advantageous implementations and further developments of the invention may be gathered from the subclaims.

Advantages Of The Invention

The invention is based on a mixing device, in particular a bulk material mixing device, with at least one mixing container comprising a receiving region for receiving a material to be mixed, with at least one mixing unit which is configured for mixing the material to be mixed that is present in the mixing container, and with at least one lump breaker unit comprising at least one cutter element which protrudes into the mixing container.

It is proposed that the at least one lump breaker unit is arranged in a frontal region of the mixing container. Preferably the lump breaker unit is arranged at least partly in an end region of the mixing container. Preferentially the cutter element protrudes into an end region of the mixing container. The mixing unit may be implemented in such a way that it is supported one-sidedly as well as in such a way that it is supported two-sidedly. Preferably at least one mixer shaft of the mixing unit is supported one-sidedly. Preferably the mixing unit is supported in an end wall, which is situated opposite the frontal region in which the lump breaker unit is arranged. A variety of mixing devices, deemed expedient by someone skilled in the art, in particular bulk material mixing devices, are conceivable, e.g. shaft mixers, like in particular dual-shaft mixers. By a "mixing container" is in particular, in this context, a container to be understood in which a mixing process of the mixing device is carried out at least partly. It is preferably to be understood, in particular, as a container comprising a receiving region for receiving a material to be mixed. The material to be mixed is received in the container in particular for a mixing process. Particularly preferably, a mixing unit, which is configured for mixing the material to be mixed, is arranged in the mixing container. The mixing container preferably has an at least substantially cylindrical basis form. Furthermore, in this context, a "mixing unit" is in particular to mean a unit which is configured for mixing the material to be mixed that is present in the mixing container. For mixing the material to be mixed, a variety of mixing units are provided which are deemed expedient by someone skilled in the art. The mixing unit preferentially comprises at least one mixer shaft, in particular at least two mixer shafts. A "mixer shaft" is herein in particular to mean a mixing element of the mixing unit, comprising at least one shaft and at least one mixing element arranged on a circumference of the shaft, in particular at least one paddle. During a mixing process the mixer shaft is in particular driven rotationally.

Furthermore, in this context, a "lump breaker unit" is in particular to mean a unit configured for comminuting clumpings occurring in the material to be mixed during operation of the mixing device. It is preferentially to mean in particular a unit with at least one cutter element, which protrudes into the mixing container and is configured to directly comminute clumpings. In particular in case of a material to be mixed that is implemented by a bulk material, clumpings may occur, e.g. due to existing humidity or introduced humidity, which are dissolvable by means of the lump breaker unit. By a "cutter element" is in particular, in this context, a tool of the lump breaker unit to be understood. The cutter element preferably comprises at least one blade, in particular rotationally driven blade, which is configured for breaking up clumpings during operation. Preferentially the cutter element comprises a plurality of blades, which are arranged offset to each other and are in particular driven rotationally. Principally, however, a different implementation of the cutter element deemed expedient by someone skilled in the art would also be conceivable. By a "frontal region" is in particular, in this context, a region of the mixing container to be understood which faces toward a front face of the mixing container. It is preferably to be understood, in particular, as a region abutting on a front-side interior wall of the mixing container. It is preferentially to be understood, in particular, viewed along a mixer shaft of the mixing unit, as an end region of the receiving region of the mixing container. The receiving region of the mixing container preferably comprises a middle region as well as two frontal regions arranged on opposite sides of the middle region. The regions are herein respectively separated from one another by imaginary planes extending perpendicularly to a rotary axis of the mixer shaft of the mixing unit. Preferably the frontal regions each take up maximally 30%, preferentially maximally 20% and especially preferentially no more than 10% of a volume of the receiving region of the mixing container. Particularly preferably the mixing container has a substantially cylindrical basis shape, at the bottom side of which the frontal region is arranged. "Configured" is in particular to mean specifically designed and/or equipped. By an object being configured for a certain function is in particular to be understood that the object fulfills and/or executes said certain function in at least one application state and/or operating state.

By an implementation of the mixing device according to the invention, in particular an advantageous arrangement of the lump breaker unit is achievable. In particular, an arrangement is achievable in which the mixing unit may be implemented of advantageously large dimensions and is only to a small extent encumbered by the lump breaker unit. In particular, a central recess in the mixing unit may be dispensed with. This allows achieving an advantageously homogeneous mixing result. Preferably furthermore a high degree of accessability of the lump breaker unit is achievable. This allows achieving an advantageously high maintenance comfort.

It is further proposed that the at least one mixing unit is supported one-sidedly. Preferably the mixing unit is supported one-sidedly on a side that is situated opposite the frontal region, in which the lump breaker unit is arranged. "Supported one-sidedly" is in particular to mean, in this context, that merely one side of the mixing unit is held via a bearing. Preferentially it is in particular to mean that only one end of a shaft, in particular of a mixer shaft, is borne. In this way in particular an arrangement is achievable in which the mixing unit may be implemented of advantageously large dimensions and is only to a small extent encumbered by the lump breaker unit. This allows achieving an advantageously high maintenance comfort.

Moreover it is proposed that the at least one lump breaker unit is arranged in an end wall of the mixing container. By an "end wall" is in particular, in this context, a wall of the mixing container to be understood which delimits a frontal region of the receiving region. Preferentially it is in particular to mean an outer wall of the mixing container, which forms a bottom side of the mixing container that differs from an encompassing surface. Depending on an orientation of the mixing container, the end wall may be oriented vertically as well as horizontally. The end wall preferably extends substantially vertically. An end wall is preferably to be understood as a wall of the mixing container that differs from a lateral wall. Especially preferentially the mixing container comprises two end walls and a circumferential lateral wall wherein, in case of a horizontal orientation of the mixing container, the lateral wall may form two sides as well as a top and/or a bottom of the receiving region of the mixing container. Preferably an end wall is in particular to mean a wall of the mixing container which is intersected by a rotary axis of the mixing unit, in particular by a mixer shaft of the mixing unit. This in particular allows achieving an especially advantageous arrangement of the lump breaker unit. In particular, an arrangement of the lump breaker unit at an end of the receiving region of the mixing container is achievable. This allows advantageously reliably and easily avoiding a collision between the mixing unit and the lump breaker unit. In particular, a collision between the mixing unit and the lump breaker unit is avoidable also in case of pulling out the mixing unit.

It is also proposed that the at least one mixing unit comprises at least one mixer shaft. Preferably the mixer shaft extends substantially in parallel to a main extension direction of the mixing container. Preferentially a rotary axis of the mixer shaft extends substantially in parallel to a main extension direction of the mixing container. Especially preferably a rotary axis of the mixer shaft extends substantially in parallel to a middle axis of the substantially cylindrical mixing container. By "at least substantially in parallel" is in particular, in this context, to be understood that an angle deviation from a parallel arrangement amounts to less than 30°, preferably to less than 15° and particularly preferably less than 5°. By a "main extension direction" of an object is herein in particular a direction to be understood that extends in parallel to a longest edge of a smallest geometric rectangular cuboid which encompasses the object just still completely. This in particular allows providing an advantageous mixing device. Preferably in particular a mixing device may be provided by means of which in particular an advantageous mixing result is achievable.

Beyond this it is proposed that a rotary axis of the cutter element of the at least one lump breaker unit extends at least substantially in parallel to a rotary axis of the at least one mixer shaft of the mixing unit. Preferably a rotary axis of the cutter element extends during operation in parallel to the rotary axis of the mixer shaft of the mixing unit. The rotary axis of the cutter element and the rotary axis of the mixer shaft of the mixing unit are preferably arranged offset with respect to one another. This in particular allows achieving an especially advantageous arrangement of the lump breaker unit. A collision between the mixing unit and the lump breaker unit is advantageously reliably and easily avoidable. In particular, a collision between the mixing unit and the lump breaker unit is avoidable also in case of pulling out the mixing unit.

It is also proposed that the mixing container comprises, in a region of an end wall, a pivot door, in which the at least one lump breaker unit is arranged. Preferably the pivot door is arranged in the end wall. Preferentially the end wall of the mixing container is at least substantially completely implemented by the pivot door. The pivot door in particular serves to make the receiving region of the mixing container accessible. This may, for example, serve for maintenance and/or cleaning purposes. Preferably, when the pivot door is opened, the lump breaker unit, in particular the cutter element of the lump breaker unit, is pivoted out of the receiving region of the mixing container. This in particular allows making the lump breaker unit accessible in an advantageously simple fashion. In this way maintenance work may be carried out advantageously easily. An advantageously high maintenance comfort is achievable.

Furthermore it is proposed that the at least one mixing unit comprises at least two mixer shafts extending substantially in parallel to each other. Preferably the mixer shafts extend completely in parallel to each other. Preferentially the mixing device is implemented as a dual-shaft mixer, in particular of a horizontally positioned dual-shaft mixer. Preferably a rotary axis of the cutter element extends during operation in parallel to the rotary axes of the mixer shafts of the mixing unit. In this way, in particular an advantageous mixing device may be rendered available. In particular, an advantageously homogeneous mixing result is achievable.

It is moreover proposed that the at least one cutter element of the lump breaker unit is arranged at least partly between the at least two mixer shafts of the at least one mixing unit. This is preferentially to mean, in particular, that at least when viewed two-dimensionally, in a plane that is perpendicular to the rotary axes of the mixer shafts, at least a partial region of the cutter element of the lump breaker unit is arranged between the at least two mixer shafts of the at least one mixing unit. It is preferably to mean in particular that, at least when viewed two-dimensionally, in a plane that is perpendicular to the rotary axes of the mixer shafts, there is at least one connecting line between a point of a first mixer shaft and a point of a second mixer shaft intersecting with the cutter element of the lump breaker unit. This in particular allows achieving an advantageous arrangement of the lump breaker unit. In particular, an arrangement is achievable allowing an implementation of the mixing unit in advantageously large dimensions. Preferably, in particular an arrangement is achievable allowing both mixer shafts conveying material to be mixed to the lump breaker unit. In this way an advantageously homogeneous mixing result is achievable.

It is further proposed that the at least one cutter element of the lump breaker unit intersects with a rotary axis of the mixer shaft of the at least one mixing unit. Preferably the at least one cutter element of the lump breaker unit intersects with a rotary axis of the mixer shaft of the at least one mixing unit in at least one operating state, in particular in at least one rotational position of the cutter element. The mixer shaft preferably comprises a recess in a region of the cutter element, allowing the cutter element intersecting with the rotary axis of the mixer shaft of the at least one mixing unit. Especially preferentially one mixer shaft of the mixing unit is shortened and does not protrude up to the end wall of the mixing container. A rotary axis of the at least one cutter element of the lump breaker unit is preferentially offset to the rotary axis of the mixer shaft, wherein the cutters of the cutter element intersect with the rotary axis of the mixer shaft in at least one operating state, in particular in at least one rotational position. In this way in particular an advantageous arrangement of the lump breaker unit is achievable. In particular, an advantageously compact arrangement is achievable.

Beyond this it is proposed that the receiving region of the at least one mixing container comprises at least one bulge which is located outside a mixing zone of the at least one mixer shaft and into which the at least one cutter element of the lump breaker unit protrudes. By a "mixing zone" is in particular, in this context, a zone, preferably a circular-cylindrical zone, of the receiving region to be understood, in which a direct mixing is carried out by the mixer shaft. Preferentially the mixing zone defines a range of the mixer shaft, in particular a range of the paddles of the mixer shaft. The bulge is preferably partly arranged between a mixing zone of a first mixer shaft and a mixing zone of a second mixer shaft. This in particular allows achieving a particularly advantageous arrangement of the lump breaker unit. In this way in particular an advantageous arrangement of the lump breaker unit is achievable without reducing a size of the mixing zone. It is thus possible to avoid the lump breaker unit protruding into an actual mixing zone of the at least one mixer shaft.

It is also proposed that, viewed in a plane that is perpendicular to a rotary axis of the at least one cutter element, the at least one cutter element of the lump breaker unit comprises a cutter impact surface, the area value of which amounts to at least 2% of an area value of a wall surface of an end wall of the mixing container. A percentage of the cutter impact surface with respect to the wall surface preferably amounts to at least 2%. Preferentially the at least one cutter element of the lump breaker unit is arranged in the end wall of the mixing container. An area value of the cutter impact surface is at least 3%, preferably at least 5% and especially preferentially at least 10% of an area value of the wall surface of the end wall. Particularly preferably, however, the area value of the cutter impact surface is maximally 35%, preferably no more than 30% and particularly preferably no more than 25% of the area value of the wall surface of the end wall. In particular in a small mixing device, the area value of the cutter impact surface preferably amounts to approximately 13% of the wall surface of the end wall. In a large mixing device the area value of the cutter impact surface preferably amounts to approximately 2% of the area value of the wall surface of the end wall. In case of two cutter elements being used in a small mixing device, the area value of the cutter impact surface preferably amounts to approximately 26% of the area value of the wall surface of the end wall, while in a large mixing device with two cutter elements the area value of the cutter impact surface preferably amounts to approximately 7% of the area value of the wall surface of the end wall. By a "cutter impact surface" is in particular, in this context, an imaginary area to be understood which, viewed in a plane that is perpendicular to a rotary axis of the at least one cutter element, is swept over by the cutter element during operation of the lump breaker unit. The area is preferably implemented by a circle area, the radius of which is equivalent to a radius of the cutter element. Preferentially the cutter impact surface extends in parallel to a main extension plane of the cutter element. By a "main extension plane" of a structural unit is in particular a plane to be understood which is parallel to a largest lateral surface of a smallest imaginary rectangular cuboid just still completely encompassing the structural unit, and which in particular extends through the center of the rectangular cuboid. By a "wall surface" is in particular, in this context, a surface of the end wall to be understood which faces towards the receiving region of the mixing container. This in particular allows rendering an advantageously efficient lump breaker unit available. An advantageously homogeneous mixing result is achievable. In particular, due to the arrangement of the lump breaker unit an advantageously large dimensioning of the at least one cutter element of the lump breaker unit is achievable.

The invention is furthermore based on a method for operating a mixing device. It is proposed that in at least one first method step material to be mixed is transported to a cutter element of at least one lump breaker unit of the mixing device by means of a mixer shaft of a mixing unit of the mixing device. Preferably, for this purpose the paddles of the mixer shaft are adjusted in such a way that a material to be mixed, which is located in the mixing zone of the mixer shaft, is transported to the cutter element of the at least one lump breaker unit of the mixing device via the paddles. In this way it is reliably achievable that clumpings in the material to be mixed are reliably destroyed by the lump breaker unit.

It is also proposed that in at least one further method step a material to be mixed is transported away from the cutter element of the at least one lump breaker unit by means of a mixer shaft of the mixing unit of the mixing device. Preferably, for this purpose, paddles of the mixer shaft are adjusted in such a way that a material to be mixed, which is conveyed into the mixing zone of the mixer shaft by the cutter element of the at least one lump breaker unit, is transported away from the cutter element of the at least one lump breaker unit by means of the paddles. In this way it is reliably achievable that clumpings in the material to be mixed are reliably destroyed by the lump breaker unit and an advantageous circulation of the material to be mixed in the mixing container is achieved.

The mixing device according to the invention and the method are herein not to be restricted to the application and implementation form described above. In particular, the mixing device according to the invention as well as the method may, to implement a functionality herein described, comprise a number of respective elements, structural components and units that differs from a number herein mentioned.

DRAWINGS

Further advantages will become apparent from the following description of the drawings. In the drawings five exemplary embodiments of the invention are shown. The drawings, the description and the claims contain a plurality of features in combination. Someone skilled in the art will purposefully also consider the features separately and will find further expedient combinations.

Figure 2:
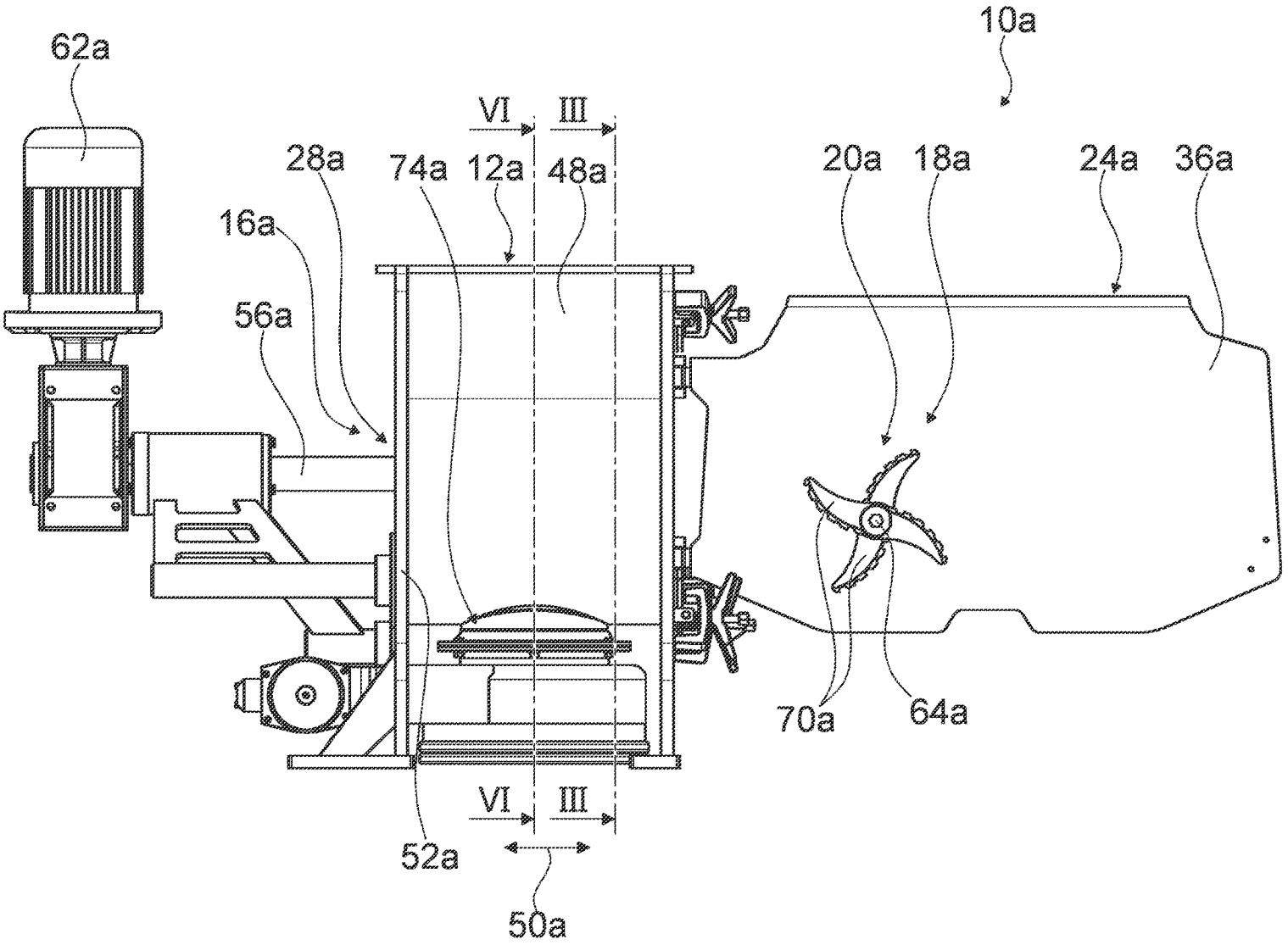
Figure 3:
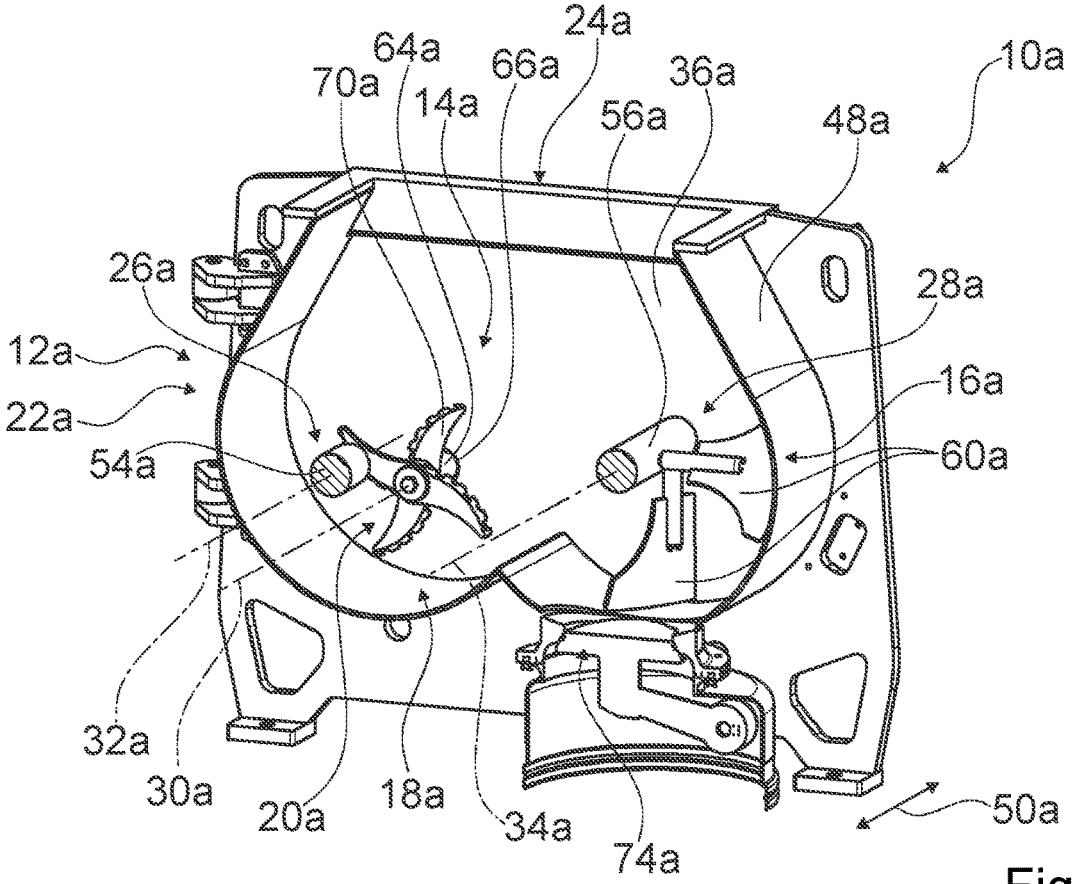
Figure 4:
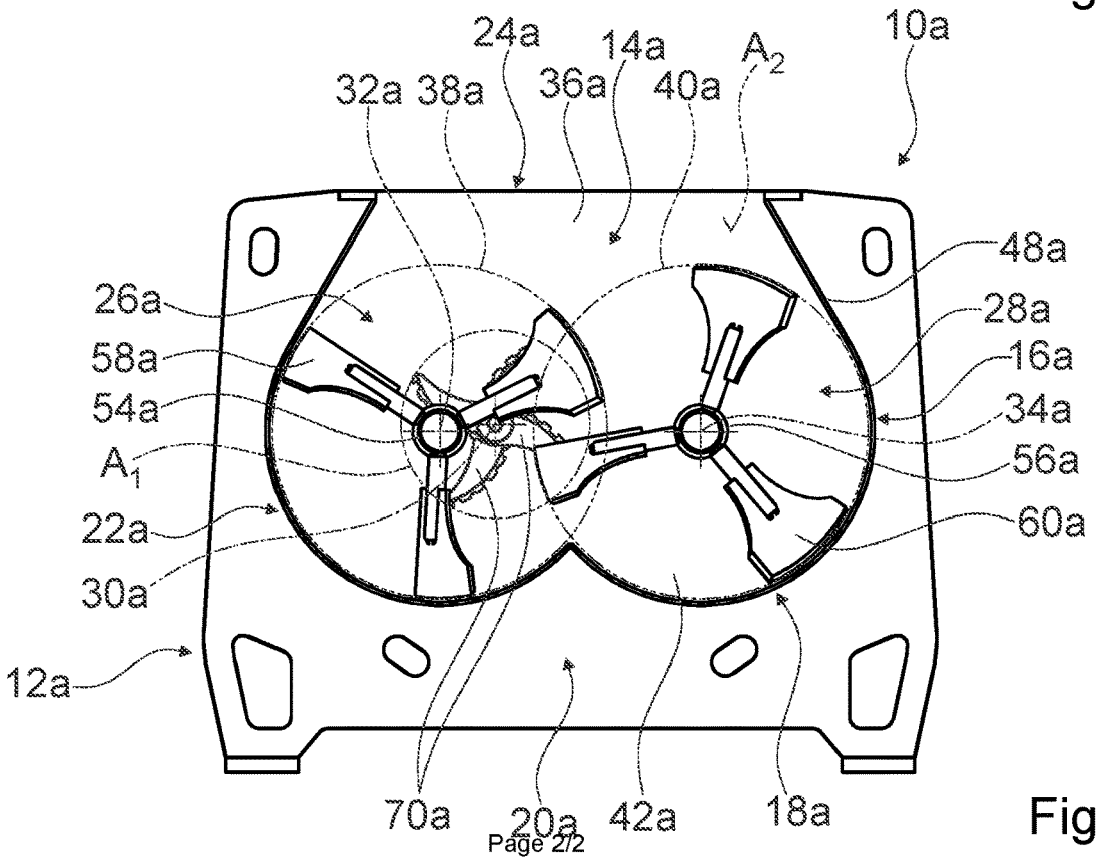
Figure 5:
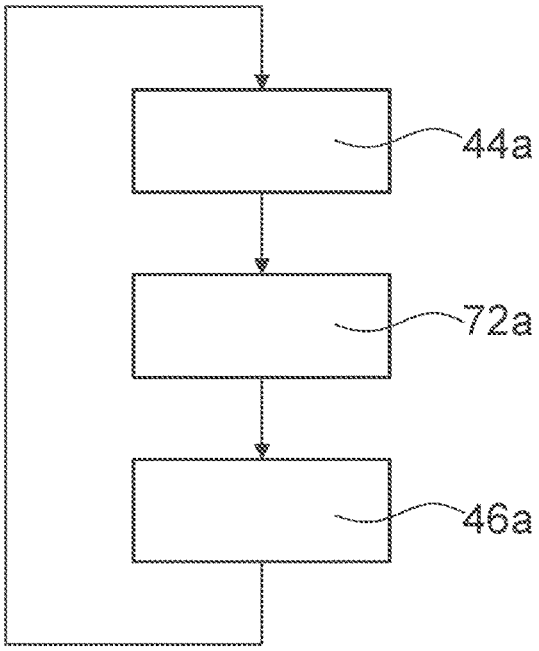
Figure 6:
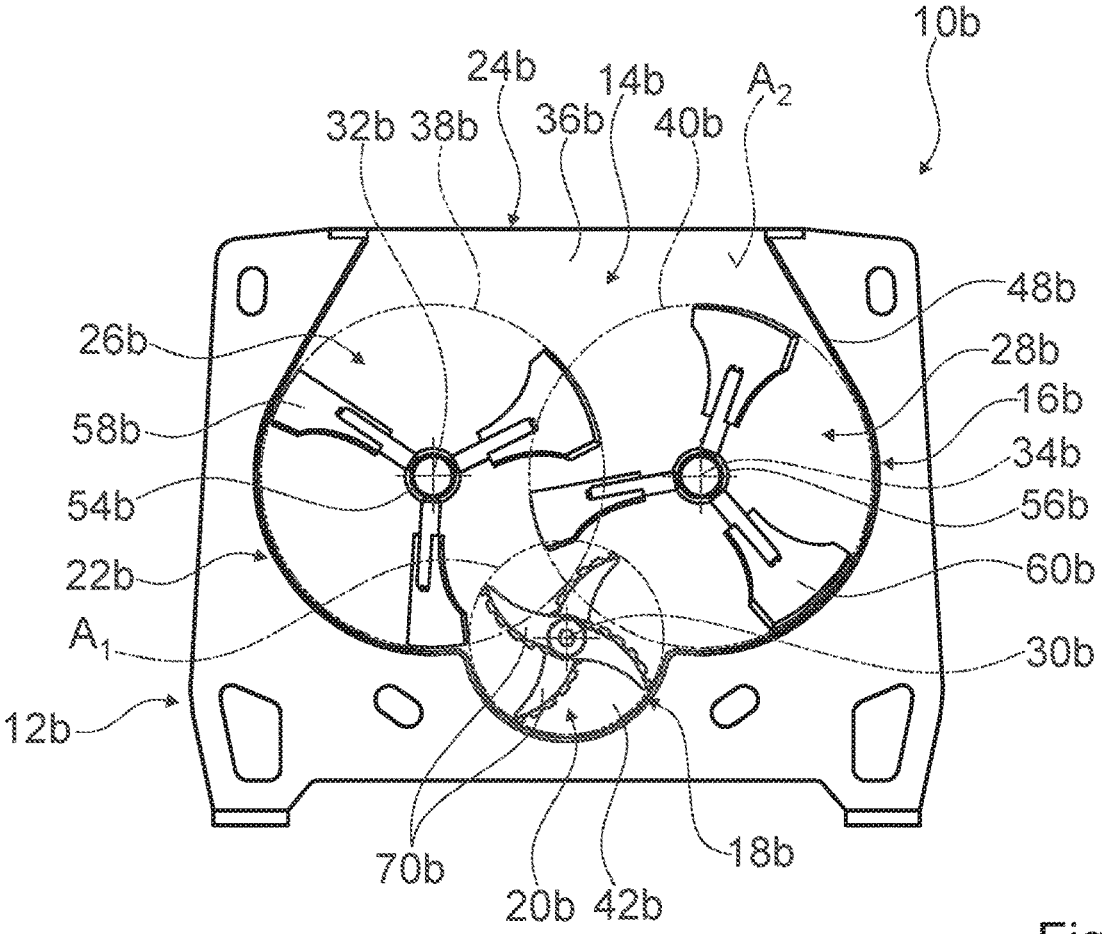
Figure 7:
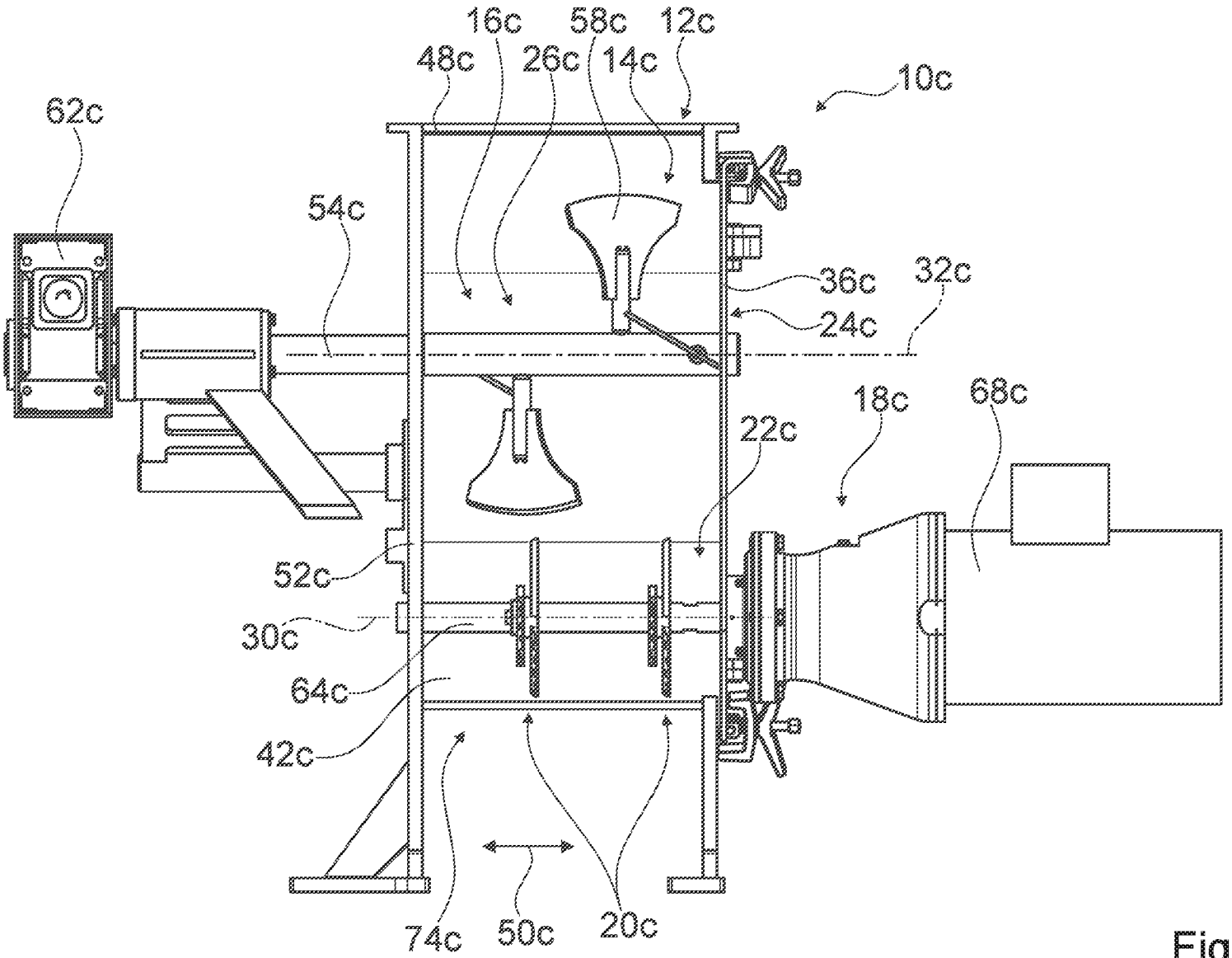
Figure 8:
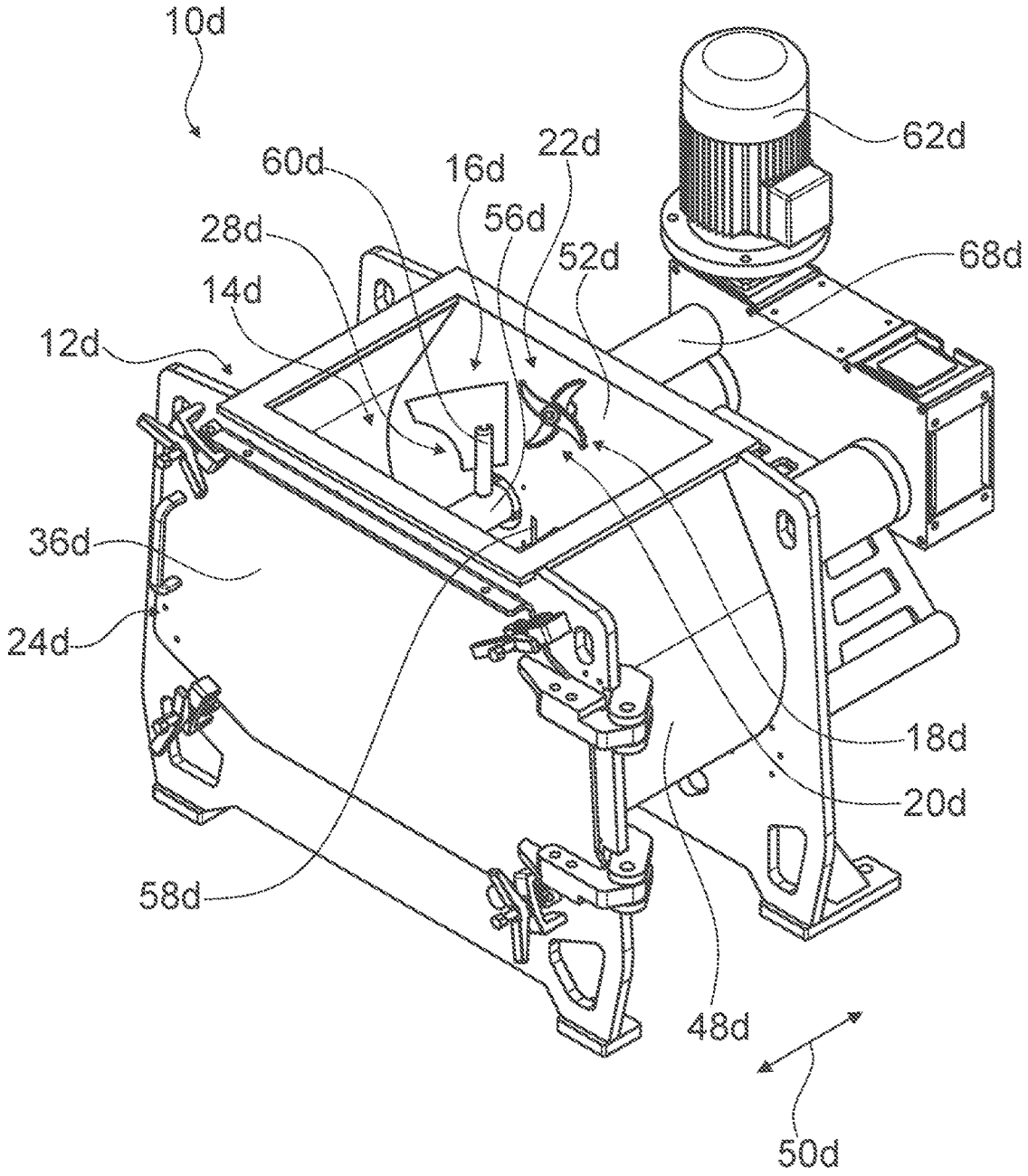
Figure 9:
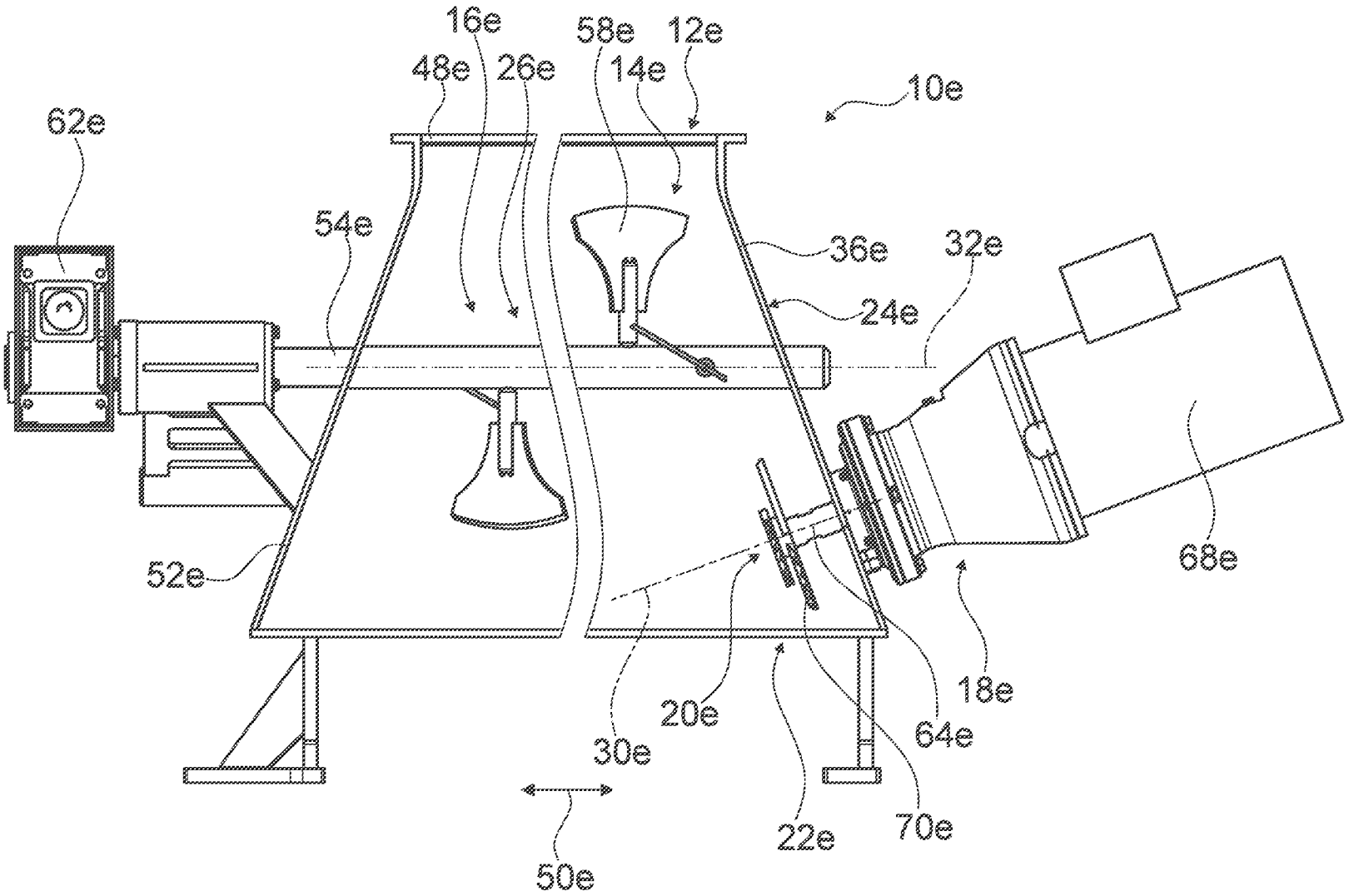

It is shown in:

FIG. 1 a mixing device according to the invention, with a mixing container, with a one-sidedly supported mixing unit and with a lump breaker unit, in a schematic presentation, in an operating state, FIG. 2 the mixing device according to the invention, with the mixing container, with the one-sidedly supported mixing unit and with the lump breaker unit, in a schematic presentation, in an opened state, FIG. 3 the mixing device according to the invention, with the mixing container, with the one-sidedly supported mixing unit and with the lump breaker unit comprising a cutter element, in a schematic sectional view along the section line III-III, FIG. 4 the mixing device according to the invention, with the mixing container, with the one-sidedly supported mixing unit and with the lump breaker unit comprising the cutter element, in a schematic sectional view along the section line IV-IV, FIG. 5 a schematic flow chart of a method for operating the mixing device, FIG. 6 an alternative mixing device according to the invention, with a mixing container, with a one-sidedly supported mixing unit and with a lump breaker unit, in a schematic sectional view perpendicularly to a rotary axis of the mixing unit, FIG. 7 a further alternative mixing device according to the invention, with a mixing container, with a two-sidedly supported mixing unit and with a lump breaker unit, in a schematic sectional view in parallel to a rotary axis of the mixing unit, FIG. 8 another alternative mixing device according to the invention, with a mixing container, with a mixing unit and with a lump breaker unit, in a schematic presentation, in an operating state, and FIG. 9 a further alternative mixing device according to the invention, with a mixing container, with a two-sidedly supported mixing unit and with a lump breaker unit, in a schematic sectional view in parallel to a rotary axis of the mixing unit.

DESCRIPTION OF THE EXEMPLARY EMBODIMENTS

FIGS. 1 and 2 show a mixing device 10*a*. The mixing device 10*a* is implemented by a bulk material mixing device. The mixing device 10*a* is implemented by a bulk material batch mixing device. The mixing device 10*a* is embodied by a two-shaft mixer. The mixing device 10*a* is embodied as a horizontally positioned dual-shaft mixer. Preferably the mixing device 10*a* may be configured for batch mixing processes as well as for continuous mixing processes. Principally however a different implementation of the mixing device 10*a*, deemed expedient by someone skilled in the art, would also be conceivable. A structure could principally also be applied for a single-shaft mixer correspondingly. By means of the mixing device 10*a*, by incidental particle exchange, in particular dispersion, and by selective dividing-up and mingling, in particular convection, a homogeneous mixing of different materials to be mixed is achieved. The mixing device 10*a* is configured for mixing solid matters as well as mixing solid matters with liquids. Principally however a different usage deemed expedient by someone skilled in the art would also be conceivable.

The mixing device 10*a* comprises a mixing container 12*a*. The mixing container 12*a* has a cylindrical basis shape. A main extension direction 50*a* of the mixing container 12*a* extends substantially horizontally during operation. The mixing container 12*a* therefore has a horizontally cylindrical basis shape. Furthermore the mixing container 12*a* implements a housing of the mixing device 10*a*. The mixing container 12*a* comprises an outer sleeve 48*a*. The outer sleeve 48*a* comprises a plurality of feet supporting the mixing container 12*a*. The mixing container 12*a* is preferably mounted on a rack (not shown in detail) via the feet of the outer sleeve 48*a*. The outer sleeve 48*a* is substantially made of metal. Principally however a different material implementation, deemed expedient by someone skilled in the art, would also be conceivable. The mixing container 12*a* further comprises a receiving region 14*a* for receiving a material to be mixed. The receiving region 14*a* has a cylindrical shape. Along a middle axis, viewed in a plane that is perpendicular to the middle axis, the receiving region 14*a* features a constant cross section. The middle axis of the receiving region 14*a* extends in parallel to the main extension direction 50*a* of the mixing container 12*a*. The receiving region 14*a* is partially delimited by the outer sleeve 48*a* of the mixing container 12*a*. The receiving region 14*a* is on an encompassing surface delimited by the outer sleeve 48*a* of the mixing container 12*a*. Furthermore the mixing container 12*a* comprises two end walls 24*a*, 52*a*. The end walls 24*a*, 52*a* close the mixing container 12*a* on two opposite ends of the outer sleeve 48*a*. The end walls 24*a*, 52*a* delimit the receiving region 14*a* on opposite ends along the middle axis of the receiving region 14*a*. The end walls 24*a*, 52*a* respectively extend in a plane that is perpendicular to the middle axis of the receiving region 14*a*. The mixing container 12*a* comprises, in the region of an end wall 24*a*, a pivot door 36*a*. The pivot door 36*a* is arranged in the end wall 24*a*. The end wall 24*a* of the mixing container 12*a* is substantially completely embodied by the pivot door 36*a*. The pivot door 36*a* serves in particular for making the receiving region 14*a* of the mixing container 12*a* accessible. The pivot door 36*a* is embodied by a front door. FIG. 2 shows the pivot door 36*a* in an opened state.

Furthermore the mixing device 10*a* comprises a mixing unit 16*a*, which is supported in a one-sided manner. The one-sidedly supported mixing unit 16*a* is configured for mixing the material to be mixed that is present in the mixing container 12*a*. The mixing unit 16*a* is one-sidedly supported in an end wall 52*a* of the mixing container 12*a*. The mixing unit 16*a* is embodied by a shaft-mixing unit. The one-sidedly supported mixing unit 16*a* comprises at least one mixer shaft 26*a*, 28*a*. The one-sidedly supported mixing unit 16*a* comprises two mixer shafts 26*a*, 28*a*. The mixer shafts 26*a*, 28*a* extend substantially in parallel to one another. The mixer shafts 26*a*, 28*a* of the mixing unit 16*a* comprise rotary axes 32*a*, 34*a*, which extend in parallel. The rotary axes 32*a*, 34*a* of the mixer shafts 26*a*, 28*a* respectively extend in parallel to the main extension direction 50*a* of the mixing container 12*a*. The mixer shafts 26*a*, 28*a* are each supported in a one-sided manner. The mixer shafts 26*a*, 28*a* are embodied by one-sidedly supported free-running mixing tools. The mixer shafts 26*a*, 28*a* are each supported in the end wall 52*a* of the mixing container 12*a*. For this purpose, a bearing for the mixer shafts 26*a*, 28*a* is arranged in the end wall 52*a*. The mixer shafts 26*a*, 28*a* are each configured of a shaft 54*a*, 56*a* as well as of a plurality of mixing elements 58*a*, 60*a* arranged on a circumference of the shaft 54*a*, 56*a*. The shafts 54*a*, 56*a* of the mixer shafts 26*a*, 28*a* are each embodied by a circle-cylindrical full shaft. Principally however a different implementation of the shafts 54*a*, 56*a*, deemed expedient by someone skilled in the art, would also be conceivable, e.g. as a hollow shaft. In case of an implementation of the shaft 54*a*, 56*a* as a hollow shaft, it would principally be conceivable that fluids, in particular liquids, could be introduced via a hollow space of the shaft 54*a*, 56*a*. In particular, liquids could be introduced into the receiving region 14*a* via the shaft. The mixing elements 58*a*, 60*a* are respectively embodied by paddles. Principally however a different implementation of the mixing elements 58*a*, 60*a*, deemed expedient by someone skilled in the art, would also be conceivable. During operation the mixer shafts 26*a*, 28*a* are arranged substantially in the receiving region 14*a* of the mixing container 12*a*. The mixer shafts 26*a*, 28*a* protrude into the receiving region 14*a*. The mixer shafts 26*a*, 28*a* define in the receiving region 14*a* respectively one circle-cylindrical mixing zone, in which a direct mixing is carried out by the respective mixer shaft 26*a*, 28*a*. The shafts 54*a*, 56*a* of the mixer shafts 26*a*, 28*a* protrude at one end through the end wall 52*a* out of the receiving region 14*a*, and are in the receiving region 14*a* driven by a drive unit 62*a*. The drive unit 62*a* drives the two mixer shafts 26*a*, 28*a* via a gearing, which is not shown. The drive unit 62*a* drives the two mixer shafts 26*a*, 28*a* rotationally. The drive unit 62*a* is embodied by a motor. The drive unit 62*a* is embodied by an electromotor. The mixing unit 16*a* is embodied in such a way that it is completely deployable out of the mixing container 12*a*. Deployment is effected via a deployment carriage (not shown in detail), on which the mixing unit 16*a* is mounted and which is guided on extension rails (not shown in detail). In a deployment, the drive unit 62*a* and the end wall 52*a* are moved as well. By a deployment of the mixing unit 16*a*, the mixer shafts 26*a*, 28*a* may be pulled out of the mixer easily and completely. In this way, the whole mixing container 12*a* is advantageously accessible for cleaning.

The mixing device 10*a* moreover comprises a lump breaker unit 18*a*. The lump breaker unit 18*a* is configured for comminuting clumpings that have occurred in the material to be mixed during operation of the mixing device 10*a*. The lump breaker unit 18*a* is arranged in a frontal region 22*a* of the mixing container 12*a*. The lump breaker unit 18*a* is arranged on a side of the receiving region 14*a* that is situated opposite the bearing point of the mixing unit 16*a*, in a frontal region 22*a* of the mixing container 12*a*. The lump breaker unit 18*a* is arranged in an end region of the mixing container 12*a*. The lump breaker unit 18*a* is arranged in the end wall 24*a* of the mixing container 12*a*. The lump breaker unit 18*a* is arranged in the end wall 24*a* of the mixing container 12*a*, which is situated opposite the end wall 52*a*, which the mixing unit 16*a* is supported in. The end wall 24*a* is arranged on a bottom side of the cylindrical mixing container 12*a*. The lump breaker unit 18*a* is arranged in the pivot door 36*a* of the mixing container 12*a*. The lump breaker unit 18*a* is arranged in the pivot door 36*a* of the end wall 24*a* of the mixing container 12*a*. Via the pivot door 36*a*, the lump breaker unit 18*a* is pivotable out of the receiving region 14*a* of the mixing container 12*a*. When the pivot door 36*a* is opened, the lump breaker unit 18*a* is pivoted as well (FIG. 2). The lump breaker unit 18*a* comprises a cutter element 20*a*, which protrudes into the mixing container 12*a*. Principally it would also be conceivable that the lump breaker unit 18*a* comprises a plurality of cutter elements 20*a* which are, for example, arranged side by side. The cutter element 20*a* protrudes into the mixing container 12*a* for a direct comminution of clumpings. The cutter element 20*a* implements a tool of the lump breaker unit 18*a*. The cutter element 20*a* comprises a shaft 64*a*, which protrudes through the pivot door 36*a* of the end wall 24*a*. In the pivot door 36*a* a bearing 66*a* for the shaft 64*a* is accommodated. On an outer side of the pivot door 36*a*, a drive unit 68*a* of the lump breaker unit 18*a* is arranged, which is configured for driving the cutter element 20*a* during operation. The drive unit 68*a* drives the shaft 64*a* of the cutter element 20*a* rotationally. The cutter element 20*a* further comprises a plurality of blades 70*a*. The cutter element 20*a* comprises two blades 70*a*. The blades 70*a* are each implemented by a double-blade implementing respectively one cutting edge on both sides of a rotary axis. Principally however a different number and/or implementation of the blades 70*a*, deemed expedient by someone skilled in the art, would also be conceivable. The blades 70*a* are respectively arranged on a free side of the shaft 64*a*, which faces away from the drive unit 68*a*. The blades 70*a* are each arranged on an end of the shaft 64*a*, which protrudes into the receiving region 14*a*. The blades 70*a* are arranged offset to each other by 90°. Principally however a different implementation of the cutter element 20*a*, deemed expedient by someone skilled in the art, would also be conceivable. The cutter element 20*a* is supported in a one-sided manner. The cutter element 20*a* is supported on a side of the receiving region 14*a* that is situated opposite the bearing point of the mixer shafts 26*a*, 28*a* of the mixing unit 16*a* (FIGS. 1 and 3).

A rotary axis 30*a* of the cutter element 20*a* of the lump breaker unit 18*a* extends substantially in parallel to the rotary axes 32*a*, 34*a* of the mixer shafts 26*a*, 28*a* of the one-sidedly supported mixing unit 16*a*. The rotary axis 30*a* of the cutter element 20*a* of the lump breaker unit 18*a* is arranged offset to the rotary axes 32*a*, 34*a* of the mixer shafts 26*a*, 28*a*. Furthermore the cutter element 20*a* of the lump breaker unit 18*a* is partially arranged between the two mixer shafts 26*a*, 28*a* of the mixing unit 16*a*. The cutter element 20*a* is arranged, at least with a partial region, viewed in a plane that is perpendicular to the rotary axes 32*a*, 34*a* of the mixer shafts 26*a*, 28*a*, between the at least two mixer shafts 26*a*, 28*a*. The cutter element 20*a* of the lump breaker unit 18*a* furthermore intersects with a rotary axis 32*a* of the first mixer shaft 26*a* of the mixing unit 16*a*. During operation the cutter element 20*a* of the lump breaker unit 18*a* intersects with the rotary axis 32*a* of the first mixer shaft 26*a* of the mixing unit 16*a* in at least one rotational position of the cutter element 20*a*. The rotary axis 30*a* of the cutter element 20*a* of the lump breaker unit 18*a* is offset to the rotary axis 32*a* of the first mixer shaft 26*a* wherein, during operation, the blades 70*a* of the cutter element 20*a* intersect with the rotary axis 32*a* of the first mixer shaft 26*a* depending on a rotational position. The first mixer shaft 26*a* comprises a recess in a region of the cutter element 20*a*, allowing the cutter element 20*a* intersecting with the rotary axis 32*a* of the first mixer shaft 26*a* of the mixing unit 16*a*. The first mixer shaft 26*a* of the mixing unit 16*a* is shortened and does not protrude up to the end wall 24*a* of the mixing container 12*a*, which the lump breaker unit 18*a* is arranged in. The first mixer shaft 26*a* of the mixing unit 16*a* is shortened with respect to the second mixer shaft 28*a*. The cutter element 20*a* is arranged at least partly below an imaginary plane extending through the rotary axes 32*a*, 34*a* of the mixer shafts 26*a*, 28*a*. The rotary axis 30*a* of the cutter element 20*a* is arranged below an imaginary plane extending through the rotary axes 32*a*, 34*a* of the mixer shafts 26*a*, 28*a* (FIG. 3).

The cutter element 20*a* of the lump breaker unit 18*a* comprises, viewed in a plane that is perpendicular to the rotary axis 30*a* of the cutter element 20*a*, a cutter impact surface $A_1$. The cutter impact surface $A_1$ extends in parallel to a main extension plane of the cutter element 20*a*. Furthermore the cutter impact surface $A_1$ extends in parallel to a main extension plane of the end wall 24*a* of the mixing container 12*a*. The cutter impact surface $A_1$ is implemented by a circle area, the radius of which is equivalent to a radius of the cutter element 20*a*. An area value of the cutter impact surface $A_1$ is at least 2% of an area value of a wall surface $A_2$ of the end wall 24*a* of the mixing container 12*a*. The area value of the cutter impact surface $A_1$ is approximately 4% of the area value of the wall surface $A_2$ of the end wall 24*a* of the mixing container 12*a*. Principally however a different area ratio that is deemed expedient by someone skilled in the art would also be conceivable. The wall surface $A_2$ of the end wall 24*a* extends in parallel to a main extension plane of the end wall 24*a*. The wall surface $A_2$ is arranged on a side of the end wall 24*a* that faces towards the receiving region 14*a* of the mixing container 12*a* (FIG. 4).

FIG. 5 shows a flow chart of a method for operating the mixing device 10*a*. FIG. 5 shows a flow chart of a mixing method. During the method a mixing of a material to be mixed, which is fed to the mixing device 10*a*, is carried out. A mixing of solid matters as well as a mixing of solid matters with liquids is carried out. For this purpose a liquid input is effected during a method (not shown in detail). For this purpose, for example, liquid is sprayed into the receiving region 14*a* by a nozzle or by a plurality of nozzles. Furthermore, during the method, in a first method step 44*a*, a material to be mixed is transported to the cutter element 20*a* of the lump breaker unit 18*a* of the mixing device 10*a* by means of the first mixer shaft 26*a* of the mixing unit 16*a* of the mixing device 10*a*. The mixing elements 58*a* of the first mixer shaft 26*a*, which are embodied as paddles, are for this purpose oriented in such a way that a material to be mixed that is present in the mixing zone of the first mixer shaft 26*a* is transported to the cutter element 20*a* of the lump breaker unit 18*a* of the mixing device 10*a* by means of the mixing elements 58*a*. The material to be mixed is herein transported towards the cutter element 20*a* along the rotary axis 32*a* of the first mixer shaft 26*a*. Then, in a second method step 72*a*, clumpings in the material to be mixed are destroyed by means of the cutter element 20*a* of the lump breaker unit 18*a*. The material to be mixed is moreover partly conveyed, in particular hurled, into the mixing zone of the second mixer shaft 28*a* by the cutter element 20*a*. Following this, in a further method step 46*a*, material to be mixed is transported away from the cutter element 20*a* of the lump breaker unit 18*a* by means of the second mixer shaft 28*a* of the mixing unit 16*a* of the mixing device 10*a*. The mixing elements 60*a* of the second mixer shaft 28*a*, which are embodied as paddles, are for this purpose oriented in such a way that a mixing material conveyed into the mixing zone of the second mixer shaft 28*a* by the cutter element 20*a* of the lump breaker unit 18*a* is transported away from the cutter element 20*a* of the lump breaker unit 18*a* by the mixing elements 60*a*. The material to be mixed is herein transported away from the cutter element 20*a* along the rotary axis 34*a* of the second mixer shaft 28*a*. Then the first method step 44*a* is repeated. The material to be mixed is hence partly conveyed through the mixing container 12*a* cyclically.

In FIGS. 6 to 9 four further exemplary embodiments of the invention are shown. The following descriptions are substantially limited to the differences between the exemplary embodiments, wherein regarding structural components, features and functions that remain the same, the description of the other exemplary embodiments, in particular of FIGS. 1 to 5, may be referred to. For distinguishing between the exemplary embodiments, the letter a in the reference numerals of FIGS. 1 to 5 has been replaced by the letters b to e in the reference numerals of the exemplary embodiments of FIGS. 6 to 9. As regards structural components with the same denomination, in particular structural components having the same reference numerals, principally the drawings and/or description of the other exemplary embodiments, in particular of FIGS. 1 to 5, may also be referred to.

FIG. 6 shows a mixing device 10*b* with a mixing container 12*b*, with a one-sidedly supported mixing unit 16*b* and with a lump breaker unit 18*b*. The one-sidedly supported mixing unit 16*b* is configured for mixing the material to be mixed that is present in the mixing container 12*b*. The mixing unit 16*b* is embodied by a shaft-mixing unit. The one-sidedly supported mixing unit 16*b* comprises two mixer shafts 26*b*, 28*b*. The mixer shafts 26*b*, 28*b* extend substantially in parallel to one another. The two mixer shafts 26*b*, 28*b* of the mixing unit 16*b* comprise rotary axes 32*b*, 34*b* running in parallel. The mixer shafts 26*b*, 28*b* each respectively define, in a receiving region 14*b* of the mixing container 12*b*, a circle-cylindrical mixing zone 38*b*, 40*b* in which a direct mixing is effected by the respective mixer shaft 26*b*, 28*b*. The mixer shafts 26*b*, 28*b* protrude along a main extension direction of the mixing container 12*b* through the entire receiving region 14*b*. The mixer shafts 26*b*, 28*b* protrude with a free end up to shortly before an end wall 24*b* of the mixing container 12*b*.

The mixing container 12*b* furthermore comprises the receiving region 14*b* for receiving a material to be mixed. The receiving region 14*b* has a substantially cylindrical shape. The receiving region 14*b* of the mixing container 12*b* comprises a bulge 42*b* that is situated outside the mixing zones 38*b*, 40*b* of the mixer shafts 26*b*, 28*b*. The bulge 42*b* is implemented by a circle-portion cylindrical bulge. The bulge 42*b* is only configured in a frontal region 22*b* of the mixing container 12*b*. Principally however it would also be conceivable that the bulge 42*b* could extend over a full length of the mixing container 12*b*. The bulge 42*b* abuts on an end wall 24*b* of the mixing container 12*b*. The bulge 42*b* is arranged below the rotary axes 32*b*, 34*b* of the mixer shafts 26*b*, 28*b*.

During operation of the mixing device 10*b*, the lump breaker unit 18*b* is also configured for a comminution of clumpings that have occurred in the material to be mixed. The lump breaker unit 18*b* is arranged in a frontal region 22*b* of the mixing container 12*b*. The lump breaker unit 18*b* is arranged, on a side of the receiving region 14*b* that is situated opposite a bearing point of the mixing unit 16*b*, in a frontal region 22*b* of the mixing container 12*b*. The lump breaker unit 18*b* is arranged in the end wall 24*b* of the mixing container 12*b*. The lump breaker unit 18*b* is arranged in a pivot door 36*b* of the end wall 24*b* of the mixing container 12*b*. The lump breaker unit 18*b* comprises a cutter element 20*b* protruding into the mixing container 12*b*. A rotary axis 30*b* of the cutter element 20*b* of the lump breaker unit 18*b* extends substantially in parallel to the rotary axes 32*b*, 34*b* of the mixer shafts 26*b*, 28*b* of the one-sidedly supported mixing unit 16*b*. The rotary axis 30*b* of the cutter element 20*b* of the lump breaker unit 18*b* is arranged offset to the rotary axes 32*b*, 34*b* of the mixer shafts 26*b*, 28*b*. Furthermore the cutter element 20*b* of the lump breaker unit 18*b* is partially arranged between the two mixer shafts 26*b*, 28*b* of the mixing unit 16*b*. The cutter element 20*b* is arranged substantially outside the mixing zones 38*b*, 40*b* of the mixer shafts 26*b*, 28*b*. The cutter element 20*b* is arranged substantially within the bulge 42*b*. The cutter element 20*b* of the lump breaker unit 18*b* protrudes into the bulge 42*b*.

FIG. 7 shows a mixing device 10*c* with a mixing container 12*c*, with a two-sidedly supported mixing unit 16*c* and with a lump breaker unit 18*c*. The two-sidedly supported mixing unit 16*c* is configured for mixing the material to be mixed that is present in the mixing container 12*c*. The mixing unit 16*c* is implemented by a shaft-mixing unit. The mixing unit 16*c* comprises two mixer shafts 26*c*. It would however principally also be conceivable that the mixing unit 16*c* comprises only one mixer shaft 26*c*. A construction may principally also be applied to a single-shaft mixer correspondingly. The mixer shafts 26*c* extend substantially in parallel to one another. The two mixer shafts 26*c* of the mixing unit 16*c* have rotary axes 32*c*, 34*c* extending in parallel. The mixer shafts 26*c* protrude through the entire receiving region 14*c* along a main extension direction of the mixing container 12*c*. The mixer shafts 26*c* are each supported on both ends.

Beyond this, the mixing container 12*c* comprises the receiving region 14*c* for receiving a material to be mixed. The receiving region 14*c* has a cylindrical shape. The receiving region 14*c* of the mixing container 12*c* comprises a bulge 42*c* that is located outside a mixing zone of the mixer shafts 26*c*. The bulge 42*c* is embodied by a circle-portion cylindrical bulge. Principally however, for example, a rectangular embodiment of the bulge 42 would also be conceivable. The bulge 42*c* extends over an entire length of the mixing container 12*c*. The bulge 42*c* abuts on an end wall 24*c* of the mixing container 12*c*. The bulge 42*c* is arranged below the rotary axes 32*c*, 34*c* of the mixer shafts 26*c*. On an underside of the bulge 42*c* a discharge opening 74*c* of the mixing device 10*c* is arranged.

Furthermore, the lump breaker unit 18*c* is configured, during operation of the mixing device 10*c*, for a comminution of clumpings that have occurred in the material to be mixed. The lump breaker unit 18*c* is arranged in a frontal region 22*c* of the mixing container 12*c*. The lump breaker unit 18*c* is arranged, on a side of the receiving region 14*c* that is situated opposite the bearing point of the mixing unit 16*c*, in a frontal region 22*c* of the mixing container 12*c*. The lump breaker unit 18*c* is arranged in the end wall 24*c* of the mixing container 12*c*. The lump breaker unit 18*c* comprises at least one cutter element 20*c* protruding into the mixing container 12*c*. The lump breaker unit 18*c* comprises a plurality of cutter elements 20*c* protruding into the mixing container 12*c*. The cutter elements 20*c* have a shared shaft 64*c*, which protrudes through the end wall 24*c*. In the end wall 24*c* a bearing for the shaft 64*c* is accommodated. On an outer side of the end wall 24*c* a drive unit 68*c* of the lump breaker unit 18*c* is arranged, which is configured for driving the cutter elements 20*c* during operation. The drive unit 68*c* drives the shaft 64*c* of the cutter elements 20*c* rotationally. The shaft 64*c* of the cutter elements 20*c* is supported in a two-sided manner. The shaft 64*c* of the cutter elements 20*c* is supported on both end walls 24*c*, 52*c* of the mixing container 12*c*. A rotary axis 30*c* of the cutter elements 20*c* of the lump breaker unit 18*c* extends substantially in parallel to the rotary axes 32*c*, 34*c* of the mixer shafts 26*c* of the mixing unit 16*c*. The rotary axis 30*c* of the cutter elements 20*c* of the lump breaker unit 18*c* is arranged offset to the rotary axes 32*c*, 34*c* of the mixer shafts 26*c*. Furthermore the cutter elements 20*c* of the lump breaker unit 18*c* are partially arranged between the two mixer shafts 26*c* of the mixing unit 16*c*. The cutter elements 20*c* are arranged substantially outside the mixing zones of the mixer shafts 26*c*. The cutter elements 20*c* are arranged substantially inside the bulge 42*c*.

FIG. 8 shows a mixing device 10*d* with a mixing container 12*d*, with a mixing unit 16*d* and with a lump breaker unit 18*d*. The mixing unit 16*d* is configured for mixing a material to be mixed that is present in the mixing container 12*d*. The mixing unit 16*d* is implemented by a shaft-mixing unit. The mixing unit 16*d* comprises two mixer shafts 28*d*. The mixer shafts 28*d* extend substantially in parallel to one another. The two mixer shafts 28*d* of the mixing unit 16*d* comprise rotary axes 32*d*, 34*d* running in parallel. The mixer shafts 28*d* are each configured of a shaft 56*d* as well as of a plurality of mixing elements 60*d*, which are arranged on a circumference of the shaft 56*d*. The shafts 56*d* of the mixer shafts 28*d* protrude at one end through an end wall 52*d* of the mixing container 12*d*, out of a receiving region 14*d*, where they are driven by a drive unit 62*d*. The drive unit 62*d* drives the two mixer shafts 28*d* via a gearing that is not shown. The drive unit 62*d* drives the two mixer shafts 28*d* rotationally.

The lump breaker unit 18*d* is moreover configured, during operation of the mixing device 10*d*, for a comminution of clumpings that have occurred in the material to be mixed. The lump breaker unit 18*d* is arranged in a frontal region 22*d* of the mixing container 12*d*. The lump breaker unit 18*d* is arranged, on a side of the receiving region 14*d* that faces towards the bearing point of the mixing unit 16*d*, in a frontal region 22*d* of the mixing container 12*d*. The lump breaker unit 18*d* is arranged in the end wall 52*d* of the mixing container 12*d*, in which end wall 52*d* the mixing unit 16*d* is also borne. The lump breaker unit 18*d* comprises a cutter element 20*d* protruding into the mixing container 12*d*. A rotary axis of the cutter element 20*d* of the lump breaker unit 18*d* extends substantially in parallel to the rotary axes of the mixer shafts 28*d* of the one-sidedly supported mixing unit 16*d*. The rotary axis of the cutter element 20*d* of the lump breaker unit 18*d* is arranged offset to the rotary axes of the mixer shafts 28*d*. The cutter element 20*d* of the lump breaker unit 18*d* is partially arranged between the two mixer shafts 28*d* of the mixing unit 16*d*.

FIG. 9 shows a mixing device 10*e* with a mixing container 12*e*, with a two-sidedly supported mixing unit 16*e* and with a lump breaker unit 18*e*. The mixing device 10*e* is implemented by a continuous bulk material mixing device. The two-sidedly supported mixing unit 16*e* is configured for mixing a material to be mixed that is present in the mixing container 12*e*. The mixing unit 16*e* is implemented by a shaft-mixing unit. The mixing unit 16*e* comprises a mixer shaft 26*e*. Principally it would however also be conceivable that the mixing unit 16*e* comprises, for example, two mixer shafts 26*e*. The mixer shaft 26*e* of the mixing unit 16*e* comprises a rotary axis 32*e*. The rotary axis 32*e* runs in parallel to a main extension direction 50*e* of the mixing container 12*e*. The mixer shaft 26*e* protrudes through an entire receiving region 14*e* along the main extension direction 50*e* of the mixing container 12*e*. The mixer shaft 26*e* is supported on both ends.

The mixing container 12*e* has a substantially cylindrical basis shape. During operation a main extension direction 50*e* of the mixing container 12*e* extends substantially horizontally. The mixing container 12*e* furthermore implements a housing of the mixing device 10*e*. The mixing container 12*e* comprises an outer sleeve 48*e*. The mixing container 12*e* also comprises the receiving region 14*e* for receiving a material to be mixed. The receiving region 14*e* has a substantially cylindrical shape. The receiving region 14*e* is partly delimited by the outer sleeve 48*e* of the mixing container 12*e*. The receiving region 14*e* is delimited on an encompassing surface by the outer sleeve 48*e* of the mixing container 12*e*. The mixing container 12*e* further comprises two end walls 24*e*, 52*e*. The end walls 24*e*, 52*e* close the mixing container 12*e* on two opposite ends of the outer sleeve 48*e*. The end walls 24*e*, 52*e* delimit the receiving region 14*e* on opposite ends along a middle axis of the receiving region 14*e*. The end walls 24*e*, 52*e* respectively run perpendicularly to the middle axis of the receiving region 14*e*. The end walls 24*e*, 52*e* are respectively inclined with respect to the rotary axis 32*e* of the mixer shaft 26*e* by a smallest angle of 70°. Principally however a different angle conceivable which is deemed expedient by someone skilled in the art. The end walls 24*e*, 52*e* are inclined away from one another on one side. The end walls 24*e*, 52*e* taper towards one another conically towards a top. The end walls 24*e*, 52*e* are respectively inclined to one another by 40°.

Furthermore the lump breaker unit 18*e* is configured, during operation of the mixing device 10*e*, for a comminution of clumpings that have occurred in the material to be mixed. The lump breaker unit 18*e* is arranged in a frontal region 22*e* of the mixing container 12*e*. The lump breaker unit 18*e* is arranged, on a side of the receiving region 14*e* that is situated opposite a bearing point of the mixing unit 16*e*, in a frontal region 22*e* of the mixing container 12*e*. The lump breaker unit 18*e* is arranged in an end wall 24*e* of the mixing container 12*e*. The lump breaker unit 18*e* comprises a cutter element 20*e* protruding into the mixing container 12*e*. The cutter element 20*e* comprises a shaft 64*e*, which protrudes through the end wall 24*e*. In the end wall 24*e* a bearing for the shaft 64*e* is accommodated. On an outer side of the end wall 24*e*, a drive unit 68*e* of the lump breaker unit 18*e* is arranged, which is configured to drive the cutter element 20*e* during operation. The drive unit 68*e* drives the shaft 64*e* of the cutter element 20*e* rotationally. A rotary axis 30*e* of the cutter element 20*e* of the lump breaker unit 18*e* extends substantially in parallel to the rotary axis 32*e* of the mixer shaft 26*e* of the mixing unit 16*e*. The rotary axis 30*e* of the cutter element 20*e* of the lump breaker unit 18*e* is inclined with respect to the rotary axis 32*e* of the mixer shaft 26*e* of the mixing unit 16*e* by at least 5°. The rotary axis 30*e* of the cutter element 20*e* of the lump breaker unit 18*e* is inclined with respect to the rotary axis 32*e* of the mixer shaft 26*e* of the mixing unit 16*e* by at least 15°. The rotary axis 30*e* of the cutter element 20*e* of the lump breaker unit 18*e* is inclined with respect to the rotary axis 32*e* of the mixer shaft 26*e* of the mixing unit 16*e* by no more than 30°. The rotary axis 30*e* of the cutter element 20*e* of the lump breaker unit 18*e* is inclined with respect to the rotary axis 32*e* of the mixer shaft 26*e* of the mixing unit 16*e* by 20°.

The invention claimed is:

1. A mixing device, comprising:

at least one mixing container with a receiving region for receiving a material to be mixed, the mixing container comprises a first end wall having an opening, a second end wall, a circumferential lateral wall, and a pivot door attached to the first end wall to cover the opening, wherein and the mixing container has a cylindrical basis shape in which the receiving region comprises a middle region and two end regions arranged on opposite sides of the middle region, and wherein the first end wall, the second end wall, and the circumferential lateral wall delimit the receiving region;

a discharge opening in the circumferential lateral wall;

a shutter for closing the discharge opening;

at least one mixing unit configured for mixing the material to be mixed that is present in the mixing container, wherein the at least one mixing unit is supported one-sidedly and comprises at least one mixer shaft; and at least one lump breaker unit comprising at least one cutter element that protrudes into the mixing container, wherein the at least one lump breaker unit is arranged in one of the two end regions of the mixing container, and the pivot door is different from the shutter.

2. The mixing device according to claim 1, wherein a rotary axis of the cutter element of the at least one lump breaker unit extends at least substantially in parallel to a rotary axis of the at least one mixer shaft of the one-sidedly supported mixing unit.

3. The mixing device according to claim 1, wherein the at least one mixing unit comprises at least two mixer shafts extending substantially in parallel to each other.

4. The mixing device according to claim 3, wherein the at least one cutter element of the lump breaker unit is arranged at least partly between the at least two mixer shafts of the at least one mixing unit.

5. The mixing device according to claim 1, wherein the at least one cutter element of the lump breaker unit intersects with a rotary axis of the mixer shaft of the at least one mixing unit.

6. The mixing device according to claim 1, wherein the receiving region of the at least one mixing container comprises at least one bulge which is located outside a mixing zone of the at least one mixer shaft and into which the at least one cutter element of the lump breaker unit protrudes.

7. The mixing device according to claim 1, wherein viewed in a plane that is perpendicular to a rotary axis of the at least one cutter element, the at least one cutter element of the lump breaker unit comprises a cutter impact surface, the area value of which amounts to at least 2% of an area value of a wall surface of an end wall of the mixing container.

8. A method for operating a mixing device according to claim 1, wherein in at least one first method step the material to be mixed is transported to the cutter element of the at least one lump breaker unit of the mixing device by means of the mixer shaft of the mixing unit of the mixing device, wherein in at least one further method step the material to be mixed is transported away from the cutter element of the at least one lump breaker unit by means of the mixer shaft of the mixing unit of the mixing device.

9. The mixing device according to claim 1, wherein the first end wall and the second end wall extend substantially vertically.

10. The mixing device according to claim 1, wherein the first end wall and the second end wall respectively extend in a plane that is perpendicular to the middle axis of the receiving region.

11. The mixing device according to claim 1, wherein a main extension direction of the mixing container extends substantially horizontally during operation, wherein a rotary axis of the mixer shaft extends substantially in parallel to the main extension direction of the mixing container.

12. A mixing device, comprising:

at least one mixing container with a receiving region for receiving a material to be mixed, the mixing container comprises a first end wall having an opening, a second end wall, a circumferential lateral wall, and a pivot door attached to the first end wall to cover the opening, wherein the mixing container has a cylindrical basis shape in which the receiving region comprises a middle region and two end regions arranged on opposite sides of the middle region, wherein the first end wall, the second end wall, and the circumferential lateral wall delimit the receiving region;

a discharge opening in the circumferential lateral wall;

a shutter for closing the discharge opening;

at least one mixing unit configured for mixing the material to be mixed that is present in the mixing container, wherein the at least one mixing unit is supported one-sidedly and comprises at least two mixer shafts, wherein the mixer shafts of the mixing unit comprise rotary axes, which extend in parallel; and at least one lump breaker unit comprising at least one cutter element which protrudes into the mixing container, wherein the at least one lump breaker unit is arranged in one of the two end regions of the mixing container, wherein the at least one cutter element of the lump breaker unit is arranged at least partly between the at least two mixer shafts of the at least one mixing unit, wherein a rotary axis of the cutter element and the rotary axes of the mixer shafts of the mixing unit are arranged offset with respect to one another, wherein the pivot door is different from the shutter element.

13. A mixing device, comprising:

a cylindrical mixing container that includes a flat front wall having a front opening, a flat rear wall, and a cylindrical sleeve that has a top inlet, lateral sides that connect the flat front wall to the flat rear wall, and a curved bottom having a bottom outlet;

a door attached to the flat front wall by hinges to open and close the front opening, the door extends parallel to the flat front wall;

a shaft bearing located in the door;

a lump breaker having one or more blades attached to a shaft, the shaft is rotatably supported by the shaft bearing with a rotary axis perpendicular to the door;

a mixing shaft that extends perpendicular from the flat rear wall, and one or more bulges that outwardly protrude from the curved bottom of the cylindrical sleeve underneath one or more of the mixing shaft and the shaft of the lump breaker.

* * * * *